US010858788B2

(12) United States Patent
Lay

(10) Patent No.: US 10,858,788 B2
(45) Date of Patent: Dec. 8, 2020

(54) MONORAIL SWITCH USING A GRAVITY-ASSISTED ACTUATING MECHANISM

(71) Applicant: Bombardier Transportation GmbH, Berlin (DE)

(72) Inventor: David Lay, Kingston (CA)

(73) Assignee: Bombardier Transportation GmbH, Berlin (DE)

( * ) Notice: Subject to any disclaimer, the term of this patent is extended or adjusted under 35 U.S.C. 154(b) by 461 days.

(21) Appl. No.: 15/751,891

(22) PCT Filed: Sep. 15, 2016

(86) PCT No.: PCT/IB2016/055509
§ 371 (c)(1),
(2) Date: Feb. 12, 2018

(87) PCT Pub. No.: WO2017/045741
PCT Pub. Date: Mar. 23, 2017

(65) Prior Publication Data

US 2018/0230657 A1 Aug. 16, 2018

Related U.S. Application Data

(60) Provisional application No. 62/218,676, filed on Sep. 15, 2015.

(51) Int. Cl.
*E01B 25/12* (2006.01)
*B61L 5/02* (2006.01)
(Continued)

(52) U.S. Cl.
CPC ..... *E01B 25/12* (2013.01); *B61L 5/02* (2013.01); *B61L 5/06* (2013.01); *B61L 7/02* (2013.01); *B61B 13/04* (2013.01)

(58) Field of Classification Search
CPC ..... B61L 7/02; B61L 5/02; B61L 5/06; E01B 25/12
See application file for complete search history.

(56) References Cited

U.S. PATENT DOCUMENTS 3,472,176 A 10/1969 Trent
5,150,655 A * 9/1992 Sakai ..... E01B 25/00 104/106

(Continued)

FOREIGN PATENT DOCUMENTS

CN 2389809 Y 8/2000
CN 201250372 Y 6/2009

(Continued)

*Primary Examiner* — Scott A Browne
(74) *Attorney, Agent, or Firm* — The Webb Law Firm

(57) ABSTRACT

A monorail switch for a monorail guideway comprises a moveable guide beam having lateral running surfaces and an actuating mechanism. The actuating mechanism, equipped with a counterweight, is operative to move the moveable guide beam from a tangent position, where the moveable guide beam is aligned with a tangent travelling direction, to a turnout position, where the moveable guide beam is aligned with a diverting direction. Potential energy stored in the counterweight is released and at least partially stored in the form of elastic potential energy in the lateral running surfaces when the moveable guide beam is moved from the tangent position to the turnout position. Similarly, the elastic potential energy stored in the lateral running surfaces is released and at least partially stored in the form of potential energy by the counterweight when the moveable guide beam is moved from the turnout position to the tangent position.

16 Claims, 8 Drawing Sheets

(51) Int. Cl.

| | |
|---|---|
| ***B61L 7/02*** | (2006.01) |
| ***B61L 5/06*** | (2006.01) |
| *B61B 13/04* | (2006.01) |

(56) References Cited

U.S. PATENT DOCUMENTS

| | | | | |
|---|---|---|---|---|
| 6,062,144 | A | 5/2000 | Benenowski et al. | |
| 2005/0038575 | A1* | 2/2005 | Wu | B61L 27/04 701/19 |
| 2008/0173209 | A1* | 7/2008 | Lechner | E01B 25/12 104/118 |
| 2015/0308052 | A1 | 10/2015 | Mancic et al. | |

FOREIGN PATENT DOCUMENTS

| | | | | |
|---|---|---|---|---|
| CN | 201354081 | Y | 12/2009 | |
| CN | 204506927 | U | 7/2015 | |
| GB | 110420 | A | 10/1917 | |
| WO | WO-2009021638 | A1 * | 2/2009 | E01B 25/12 |
| WO | 2009059362 | A1 | 5/2009 | |
| WO | 2013110859 | A1 | 8/2013 | |

* cited by examiner

MONORAIL SWITCH USING A GRAVITY-ASSISTED ACTUATING MECHANISM

CROSS-REFERENCE TO RELATED APPLICATIONS

This application is the United States national phase of International Application No. PCT/IB2016/055509 filed Sep. 15, 2016, and claims the benefit of U.S. Provisional Patent Application No. 62/218,676 filed Sep. 15, 2015, the disclosures of which are hereby incorporated in their entirety by reference.

FIELD OF THE INVENTION

The present invention generally relates to the field of infrastructures for mass transit vehicles. More specifically, the invention relates to a switch for a monorail guide beam using gravity to assist in its operation.

BACKGROUND OF THE INVENTION

Elevated monorail guideways, adapted to support and guide monorail vehicles, are imposing infrastructures. As these guideways constitute a circuit, providing many travelling options to a traveler, they use switches permitting the selection of the direction in which the monorail is to travel. The same as for the rest of the guideway, these switches are also imposing pieces of infrastructure. Such switches, typically made of one or more moveable beams, have to combine two opposing objectives: by nature, they have to be mobile to switch between a tangent position and a turnout position, but they are also required to precisely hold that position once in place, withstanding the vertical and lateral forces imposed by the travelling monorail. Consequently, these switches typically require large actuators to move them and to hold them in place.

Different types of monorail switches exist. A first type is the replacement beam switch where two beams, usually one being straight and the other one being curved, are attached to each other at a predetermined distance. The switch is operated by laterally displacing the beams, one replacing the other to complete the guideway. The drawback of these switches is that they take up much space on each side of the guideway, requiring additional infrastructure.

A second type of switch is known as the pivot switch. It uses a single beam pivoted at its base. Although very simple and compact, this design creates a sharp angular deviation of the beam alignment when the beam is in its turnout position. Not only does this sharp deviation result in noticeable discomfort for travelers in a monorail going across this switch, but it also creates high lateral loads on the travelling monorail. Consequently, this type of switch requires much reduced speeds through the turnout position in order to limit loads on the monorail vehicle.

A third type of switch, a variant of the single pivot beam switch, uses a plurality of shorter fixed straight beams, each pivotally connected to the end of the previous beam. Although this reduces the single sharp angular deviation of the single pivot switch, it results in a series of smaller sharp angular deviations which still imposes a reduced speed on a circulating monorail vehicle.

Yet another type of switch, which is not typically used in the mass transit technological field, could be considered: a flexible beam capable of being bent from its straight tangent position to a curved turnout position. However, with current material technology, it is impossible to use such switches in a mass transit monorail guideway as no economical material exist that is sufficiently flexible to flex into the turnout position yet rigid enough to withstand the large lateral and vertical loads imposed by a monorail. Moreover, as the beam would be flexed, large quantities of energy would be stored in the beam, creating a safety hazard.

Because all these types of monorail switches have drawbacks, there is a clear need for an improved monorail switch.

SUMMARY OF THE INVENTION

It is an object of the present invention to provide a switch for a monorail guideway that overcomes or mitigates one or more disadvantages of known monorail switches, or at least provides a useful alternative.

The invention provides the advantages of requiring a smaller actuator to operate. It also helps mitigating the risk associated with the uncontrolled release of elastic potential energy stored in a bent moveable guide beam when in a turnout position.

In accordance with an embodiment of the present invention, there is provided a monorail switch for a monorail guideway. The monorail switch comprises a moveable guide beam and an actuating mechanism connected to it. The moveable guide beam has a first end and a second end, which second end is adapted to be connected to the guideway. The moveable guide beam has lateral running surfaces on its left and right sides. The actuating mechanism, which is equipped with a counterweight, is operative to move the moveable guide beam from a tangent position to the turnout position. Potential energy stored in the counterweight is released and at least partially stored in the form of elastic potential energy in the lateral running surfaces when the moveable guide beam is moved from the tangent position to the turnout position. Similarly, the elastic potential energy stored in the lateral running surfaces is released and at least partially stored in the form of potential energy by the counterweight when the moveable guide beam is moved from the turnout position to the tangent position.

When the moveable guide beam is in the tangent position, the counterweight is in a high potential energy position. When the moveable guide beam is in the turnout position, the counterweight is in a low potential energy position.

Optionally, the actuating mechanism may further comprise a lever having a fulcrum and a swinging extremity. In this case, the counterweight is connected to the swinging extremity. The counterweight may be substantially vertically aligned above the fulcrum when the moveable guide beam is in the tangent position while it is vertically offset from the fulcrum when the moveable guide beam is in the turnout position. Preferably, the counterweight is horizontally aligned with the fulcrum when the moveable guide beam is in the turnout position.

Preferably, a mass M of the counterweight and a length L of the lever are selected so that a sum of torque at the fulcrum is null when the moveable guide beam is proximate the turnout position. Similarly, the mass M and the length L may also be selected so that the sum of torque at the fulcrum is null when the moveable guide beam is proximate the tangent position.

The actuating mechanism is preferably connected to the moveable guide beam proximate the first end.

The lateral running surfaces may extend approximately the whole length of the moveable guide beam, from a position proximate the first end to a position proximate the second end.

Optionally, the lateral running surfaces may comprise an upper set and a lower set of running surfaces. The left and right running surfaces of the upper set are connected together while the left and right running surfaces of the lower set are also connected together.

The moveable guide beam may comprise an alignment of segments pivotally connected end-to-end to each other by pivots. As with other options, the lateral running surfaces extend on each sides of the segments.

Optionally, the moveable guide beam may further comprise rotation stops between each one of the segments. The rotation stops prevent two adjacent segments from pivoting beyond a predetermined angle with respect to each other. Similarly, another rotation stop may be used proximate the second end so as to prevent the segment at the second end from pivoting beyond a predetermined angle with respect to the guideway.

Preferably, the monorail switch uses only one actuating mechanism connected to the single segment at the first end of the moveable guide beam.

Optionally, the actuating mechanism may be connected to the moveable guide beam through a linkage.

Alternatively, the actuating mechanism may comprise a cam and a cable where the cable interconnects the cam to the moveable guide beam. The cable is operative to conform at least partially to a profile of the cam as the moveable guide beam moves from the tangent position to the turnout position.

Preferably, the monorail switch further comprises a locking mechanism operative to selectively lock the moveable guide beam either in the tangent position or in the turnout position, depending on the instant position of the moveable guide beam.

BRIEF DESCRIPTION OF DRAWINGS

These and other features of the present invention will become more apparent from the following description in which reference is made to the appended drawings wherein.

DETAILED DESCRIPTION OF THE INVENTION

The present invention relates to a monorail switch for a monorail guideway where an actuating mechanism advantageously leverages gravity to help in the operation of the switch.

Figure 1:
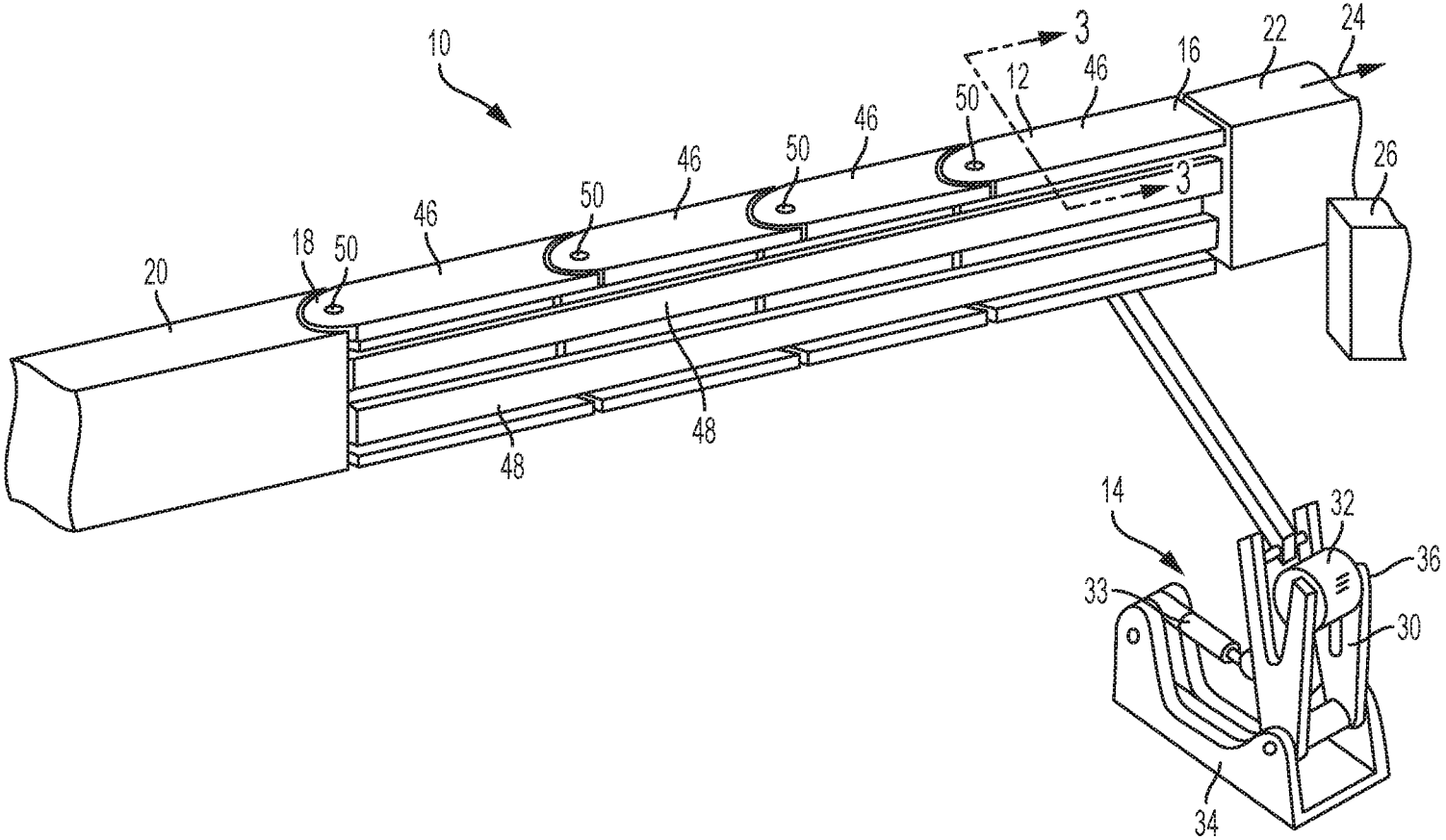
FIG. 1 is an isometric view of a monorail switch shown in tangent position in accordance with an embodiment of the present invention.
Figure 2:
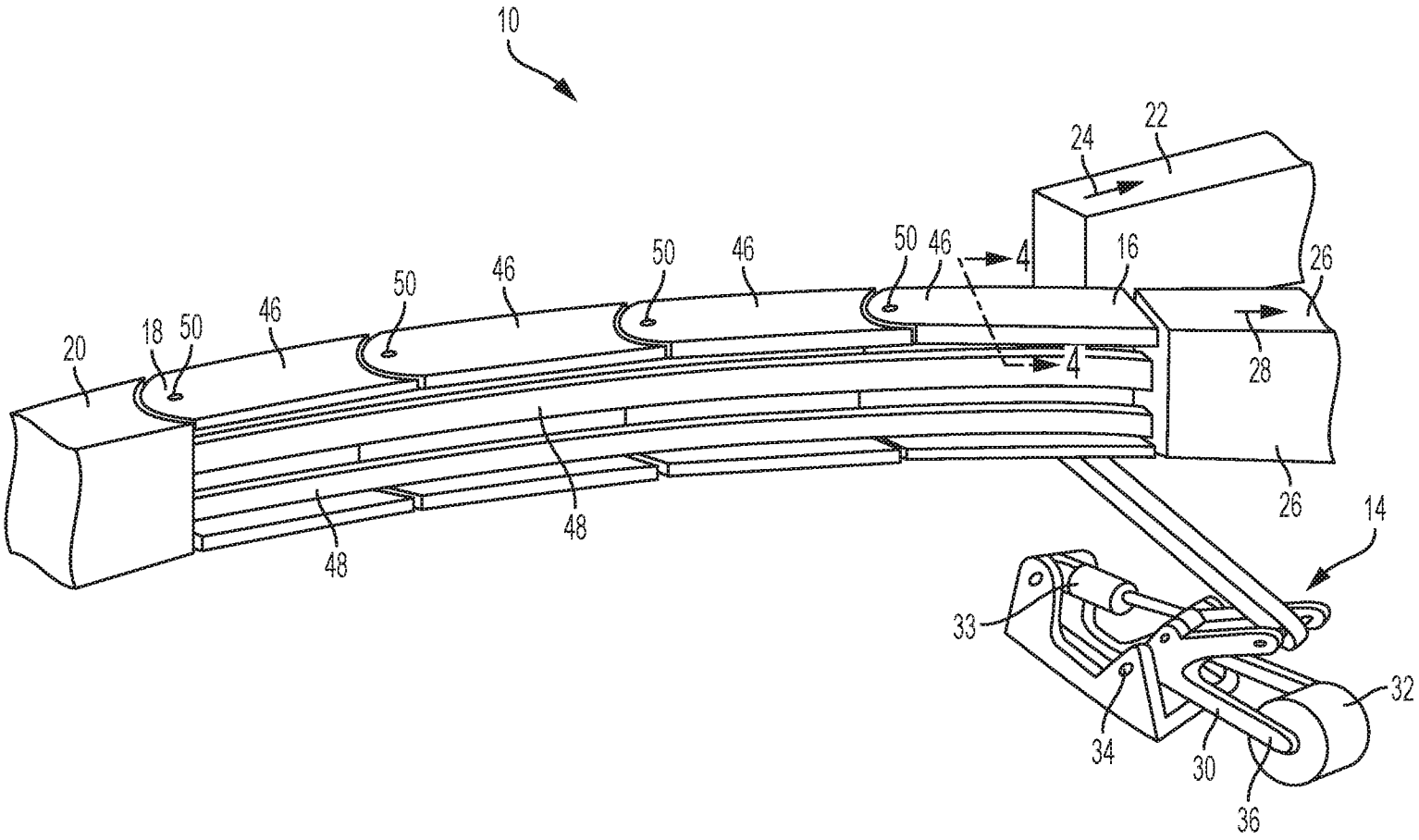
FIG. 2 is an isometric view of the monorail switch of FIG. 1 shown in turnout position.

FIG. 1 is now referred to. A monorail switch 10 comprises a moveable guide beam 12 and an actuating mechanism 14. The moveable guide beam has a free first end 16 and a second end 18 pivotally connected to a guideway 20. The actuating mechanism 14 is connected to the moveable guide beam 12, preferably proximate its first end 16, allowing rotating or bending the moveable guide beam 12 along its whole length. The actuating mechanism 14 is operative to laterally displace the moveable guide beam 12 from a tangent position, as shown in FIG. 1, to a turnout position, as shown in FIG. 2. In the tangent position, the moveable guide beam 12 is aligned with a main portion 22 of the guideway 20 and is oriented according to a first travelling direction 24. In the turnout position, the moveable guide beam 12 is aligned with a diverting portion 26 of the guideway 20 and is oriented with a second travelling direction 28 diverting from the first travelling direction 24.

The moveable guide beam 12 may be made from an alignment of segments 46 pivotally connected to each other by pivots 50. Flexible running surfaces 48, located on each sides of the segments 46, are designed to provide a smooth running surface to a monorail's guide wheels. The right and left running surfaces 48 may each be split in two, thereby creating an upper and a lower running surface. This makes for an upper right running surface 48*a*, a lower right running surface 48*b*, an upper left running surface 48*c* and a lower left running surface 48*d*. Creating split running surfaces 48 not only saves weight and material while decreasing lateral stiffness, but also allows the set of upper running surfaces 48*a*, 48*c* to behave independently from the set of lower running surfaces 48*b* and 48*d*. Moreover, using an alignment of segments 46 makes it easier to manipulate and assemble the segments 46 into the switch when on site, especially considering that this assembly is usually completed at some 15 meters (approximately 49 feet) above the ground.

In order to provide a smooth transition from one segment 46 to another, the lateral running surfaces 48 extend over at least one of the pivots 50. The lateral running surfaces 48 may either be clamped to the guideway 20, as shown in FIGS. 1 and 2, may stop at the guideway 20 and be pivotally connected to the guideway 20 or may only be floatingly connected to the moveable guide beam 12. The running surfaces 48 provide a smooth transition between the guideway 20 and the moveable guide beam 12, making the monorail entry in the switch 10 much more comfortable for passengers. However, such running surfaces 48 also laterally stiffen the moveable guide beam 12, as the running surfaces 48 act as leaf springs. In both cases, the lateral running surfaces 48 may extend from a position proximate the first end 16 to a position proximate the second end 18 of the moveable guide beam 12. For convenience (i.e. for easier shipping), the lateral running surfaces 48 may also be split into shorter portions and then assembled together on site. However, it is always preferable that these shorter portions extend at least over one of the pivots 50 connecting two segments 46, and it is also preferable that these shorter portions be rigidly connected to each other so as to provide a continuous smooth curvature of the lateral running surfaces 48.

Figure 3:
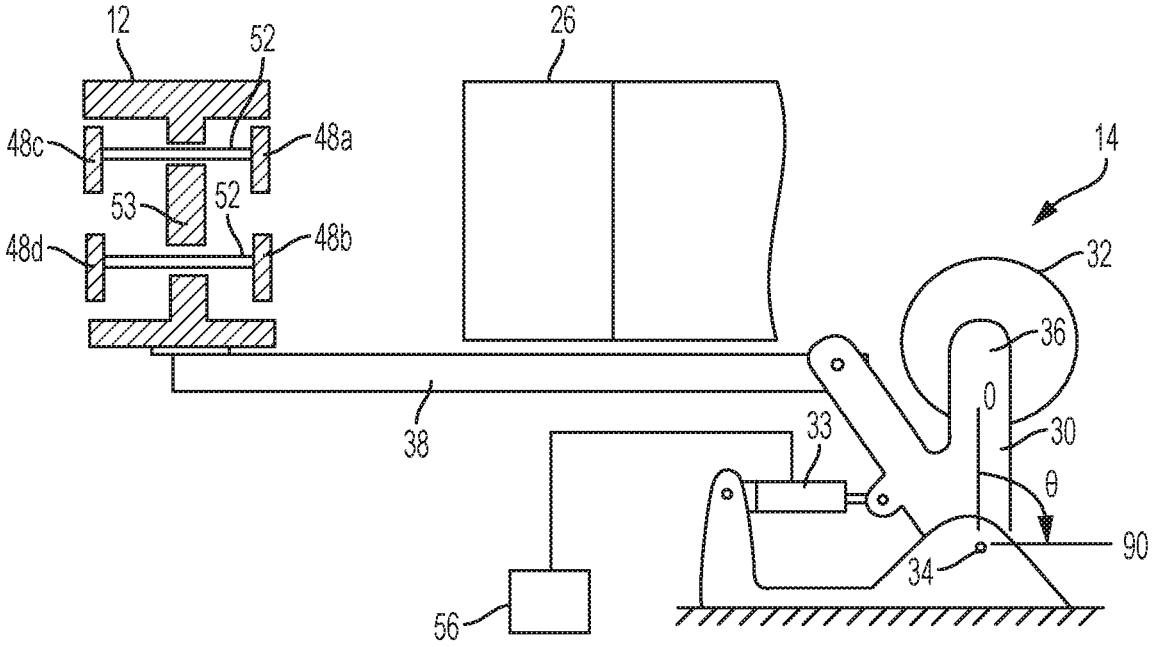
FIG. 3 is a partial cross-sectional front view of the monorail switch of FIG. 1.
Figure 4:
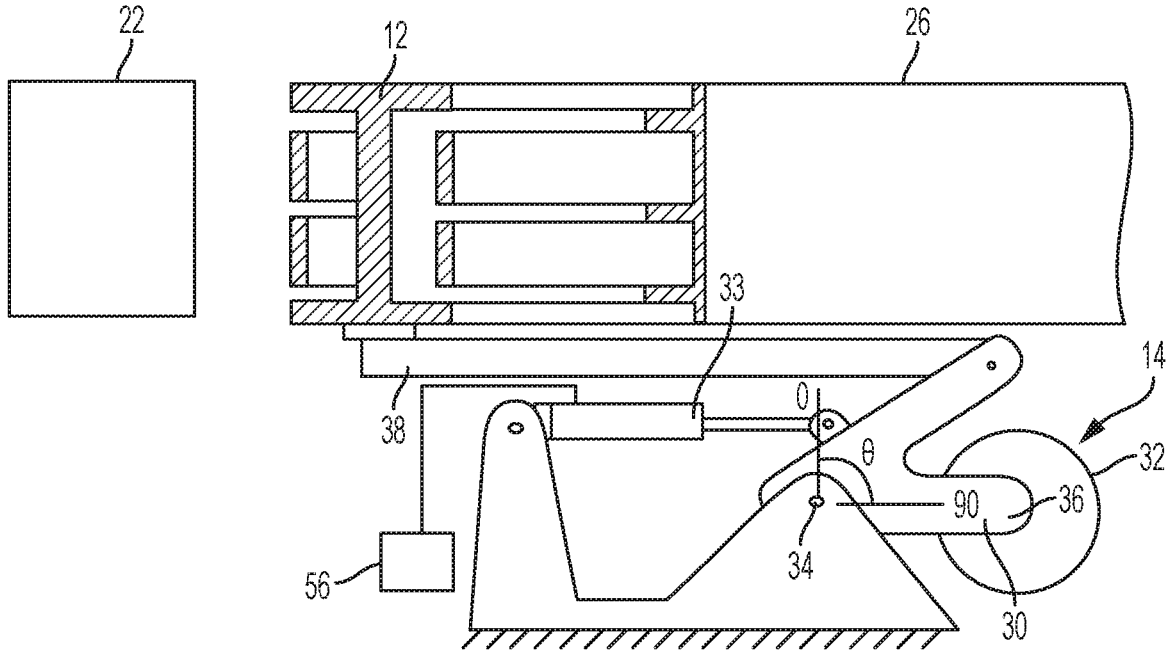
FIG. 4 is a partial cross-sectional front view of the monorail switch of FIG. 2.

Optionally, the lateral running surfaces 48 located on each side of the moveable guide beam 12 may be interconnected together by a link 52, as best shown in FIGS. 3 and 4, now concurrently referred to. This link 52 may move laterally with respect to a web 53 of the moveable guide beam 12. This interconnection allows providing a more constant distance between two opposed lateral running surfaces 48, thereby preventing loss of guide tire preload and doubling an effective bending stiffness thereby preventing excessive deviation of the guide beam alignment due to dynamic forces as the monorail vehicle traverses the switch. The upper right running surface 48*a* is therefore connected to the upper left running surface 48*c* and the lower right running surface 48*b* is connected to the lower left running surface 48*d*.

Figure 5:
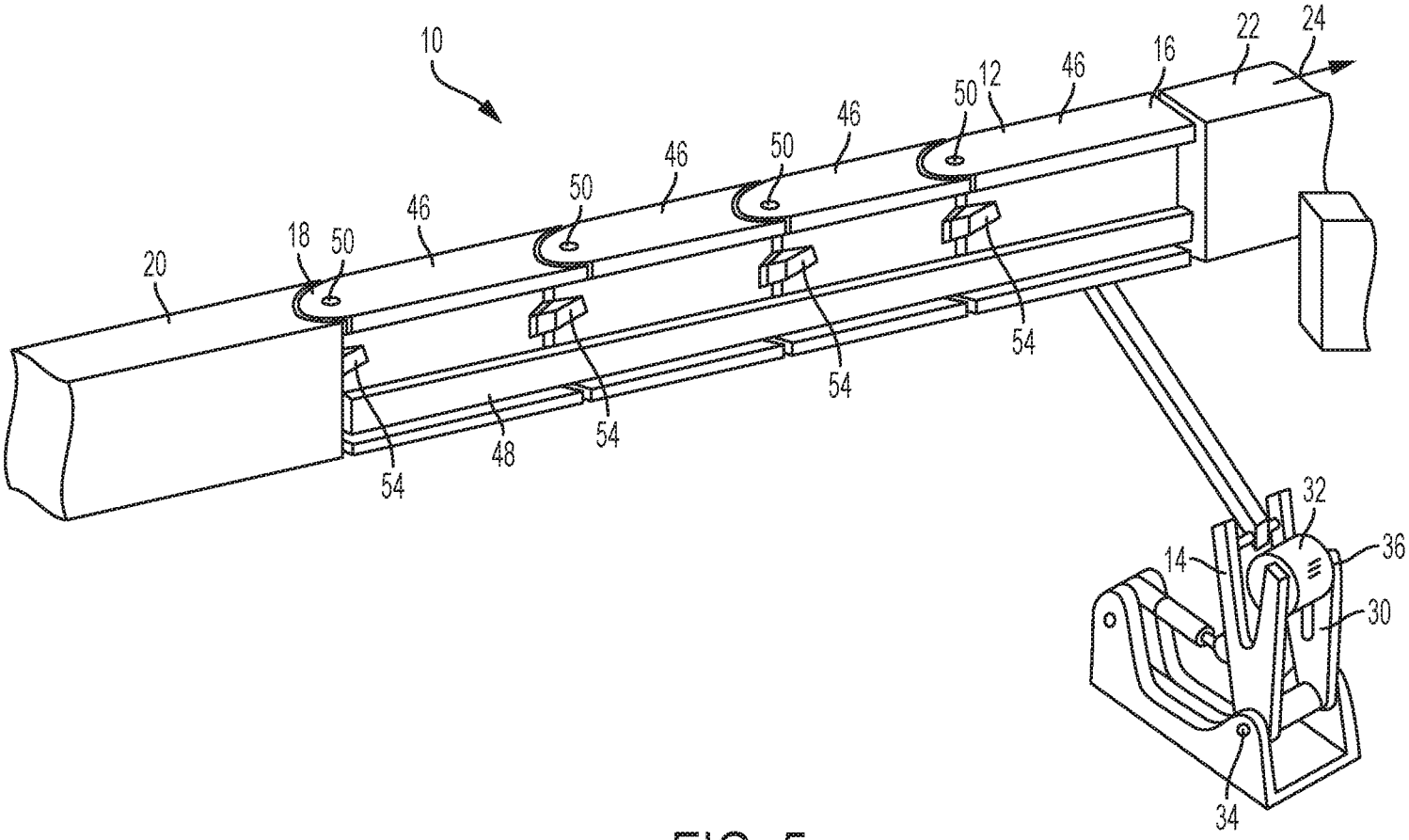
FIG. 5 is an isometric view of the monorail switch of FIG. 1 with a portion of a lateral guiding surface removed.

FIG. 5 is now concurrently referred to. The moveable guide beam 12 may also be equipped with rotation stops 54 between each one of the segments 46. The rotation stops 54 prevent two adjacent segments 46 from pivoting beyond a predetermined angle with respect to each other. In a similar way, the monorail switch 10 may comprise a similar rotation stop 54 proximate the second end 18 of the moveable guide beam 12 so as to prevent the segment 46 at the second end 18 from pivoting beyond a predetermined angle with respect to the guideway 20. Rotation stops 54 may be used on both side of the moveable guide beam 12, thereby prevent two adjacent segments 46 from pivoting beyond a predetermined angle, whether in the turnout position, or in the tangent position.

As best shown in FIGS. 3 and 4, the actuating mechanism 14 comprises a lever 30, a counterweight 32 and an actuator 33. The lever 30 has a fulcrum 34 and a swinging extremity 36 to which the counterweight 32 is connected. The actuator 33, under the control of a controller, is operative to swing the lever 30 around its fulcrum 34, thereby modifying the position of the counterweight 32 and of the moveable guide beam 12. The actuator 33 may be any type of known suitable device capable of inducing a motion to the lever 30 and to the counterweight 32 such as, for example, an electromechanical piston, a hydraulic piston, an electric motor, an engine, etc.

Advantageously, because the actuating mechanism 14 is preferably connected proximate the first end 16 of the moveable guide beam 12 and because the lateral running surfaces 48 are connected to each other and extend along the whole length of the moveable guide beam 12, it is possible to use a single actuating mechanism 14, even if the moveable guide beam 12 is made of a linear series of pivotally connected segments 46. Indeed, the lateral running surfaces 48 act as leaf springs smoothly bent when not in their tangent position, precisely guiding the segments 46 in between them.

Figure 6:
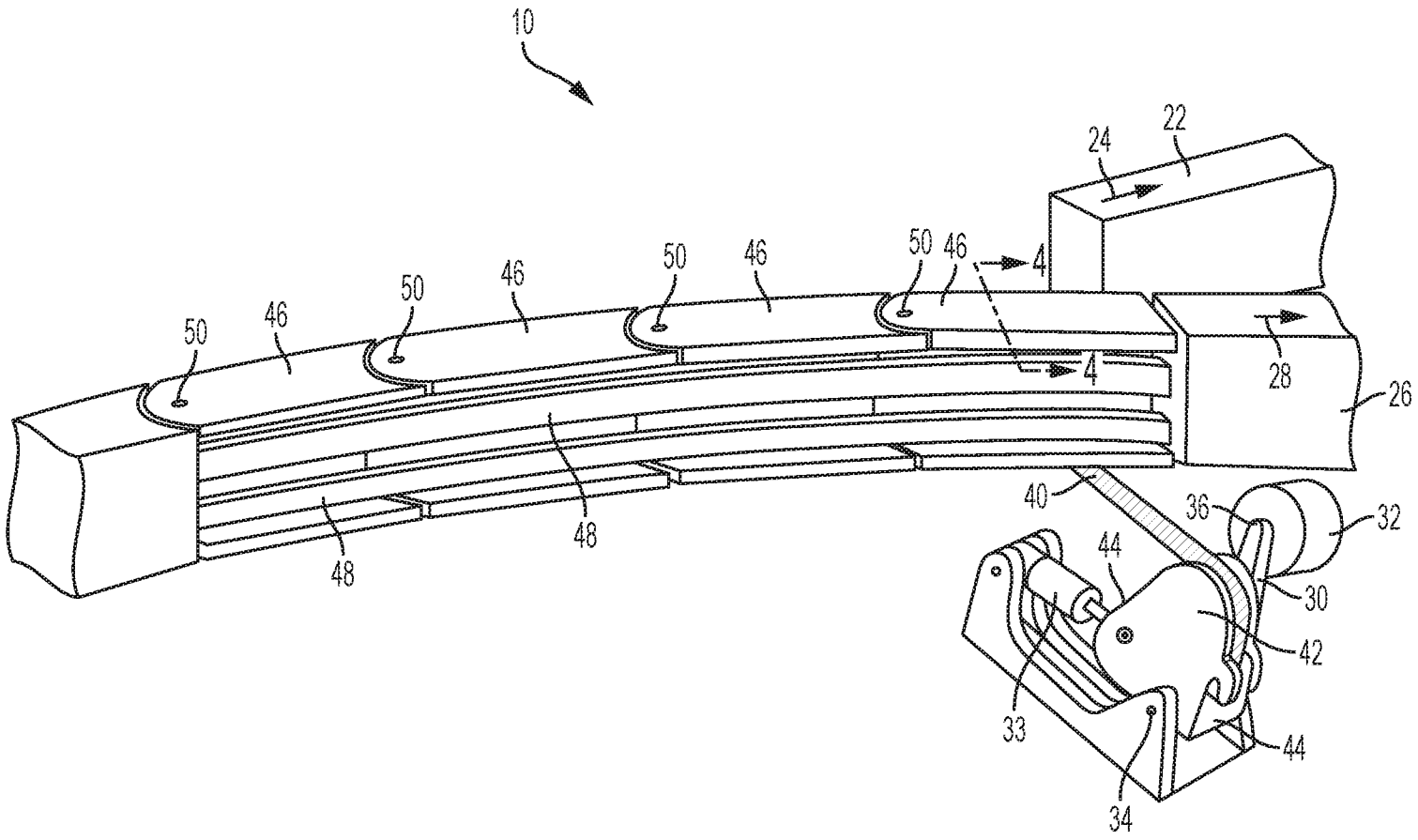
FIG. 6 is a front view of an actuating mechanism in accordance with another embodiment of the present invention.

The actuating mechanism 14 may be connected to the moveable guide beam 12 either through a linkage 38, through a cable 40 (as best shown in FIG. 6, now concurrently referred to), or through any other known suitable mechanism. If connected with the cable 40, the actuating mechanism 14 uses a cam 42 where the cable 40 interconnects the cam 42 to the moveable guide beam 12. The cable 40 is operative to conform at least partially to a profile 44 of the cam 42 as the moveable guide beam 12 moves from its tangent position to its turnout position. The profile of the cam 42 may be designed so that the resulting torque at the fulcrum, developed by the counterweight 32 and a reaction beam flexing force F (the force required to rotate or bend the moveable guide beam 12) of the moveable guide beam 12, is as close to being null as possible. This means that the actuator 33 needs to develop only a small force to move the moveable guide beam 12. It also means that there is little energy stored in the moveable guide beam 12, thereby reducing risk.

When the actuating mechanism 14 holds the moveable guide beam 12 in the tangent position, as shown in FIG. 1, the counterweight 32 is in a position of high potential energy. One such high potential energy position is, for example, when the counterweight 32 is above the fulcrum 34, and more particularly substantially vertically aligned above the fulcrum 34. This is best shown in FIG. 3. As the actuating mechanism 14 displaces the moveable guide beam 12 towards the turnout position, the counterweight 32 moves downwardly towards a position of low potential energy. The potential energy stored in the counterweight 32 is then gradually released and at least partially transferred and stored in the form of elastic potential energy in the lateral running surfaces 48. When the moveable guide beam 12 reaches the turnout position, as shown in FIGS. 2 and 4, the counterweight 32 ends up being vertically offset from the fulcrum 34 in a lower potential energy position, or basically at its lowest potential energy position of its range.

Conversely, as the actuating mechanism 14 displaces the moveable guide beam 12 from the turnout position towards the tangent position, the elastic potential energy stored in the lateral running surfaces 48 is at least partially gradually transferred and stored in the form of potential energy by the counterweight 32, which then moves from its low potential energy position to its high potential energy position.

Theoretically, all of the potential energy store in the counterweight 32 or in the lateral running surfaces 48 could be transferred infinitely between the two. However, because of friction between components, there is always a small quantity of energy lost and the actuator 33 always need to introduce some energy in the switch 10.

Preferably, when the moveable guide beam 12 is in the turnout position, the counterweight 32 is not only offset from the fulcrum 34, but horizontally aligned with the fulcrum 34. This maximizes the moment arm (the perpendicular distance between the fulcrum 34 and a downward vertical force W acting on a center of mass of the counterweight 32). This downward vertical force W corresponds to a weight of the counterweight 32, calculated as the product of its mass M with g, the gravitational constant. Typically, the linkage 38 is attached approximately 45 degrees offset from the center of mass of the counterweight 32 so that when the counterweight rotates 90 degrees from its starting position directly above the fulcrum 34, the linkage attachment to the actuating mechanism 14 rotates approximately from a −45 degrees to a +45 degrees position with respect to a vertical axis, having as little variation of its effective moment arm as possible. The mass M of the counterweight 32 and a length L of the lever 30 are selected so that the sum of torque at the fulcrum 34 is null, or at least relatively low, when the moveable guide beam 12 is in the turnout position, or close to it. This minimizes the force required by the actuator 33 (and consequently reduces its size and its cost) to hold the moveable guide beam 12 in this position. Similarly, the mass M and the length L may be selected so that the sum of torque at the fulcrum 34 is null when the moveable guide beam 12 is at, or proximate, its tangent position. This also minimizes the force required by the actuator 33 to hold the moveable guide beam 12 in this position.

It may be noted that the counterweight 32 does not have to be exactly vertically above the fulcrum 34 when the moveable guide beam 12 is in the tangent position. Similarly, the counterweight 32 does not have to rotate by exactly 90 degrees around the fulcrum 34 or end up being horizontally aligned with the fulcrum 34 when the moveable guide beam has reached its turnout position. Some variations on the exact position of the counterweight 32 with respect to the fulcrum 34 when the moveable guide beam 12 is in either its tangent or turnout position are possible, as much as variations on the angular displacement of the counterweight 32 around the fulcrum 34, while still providing acceptable results, although maybe not optimal ones.

Figure 7:
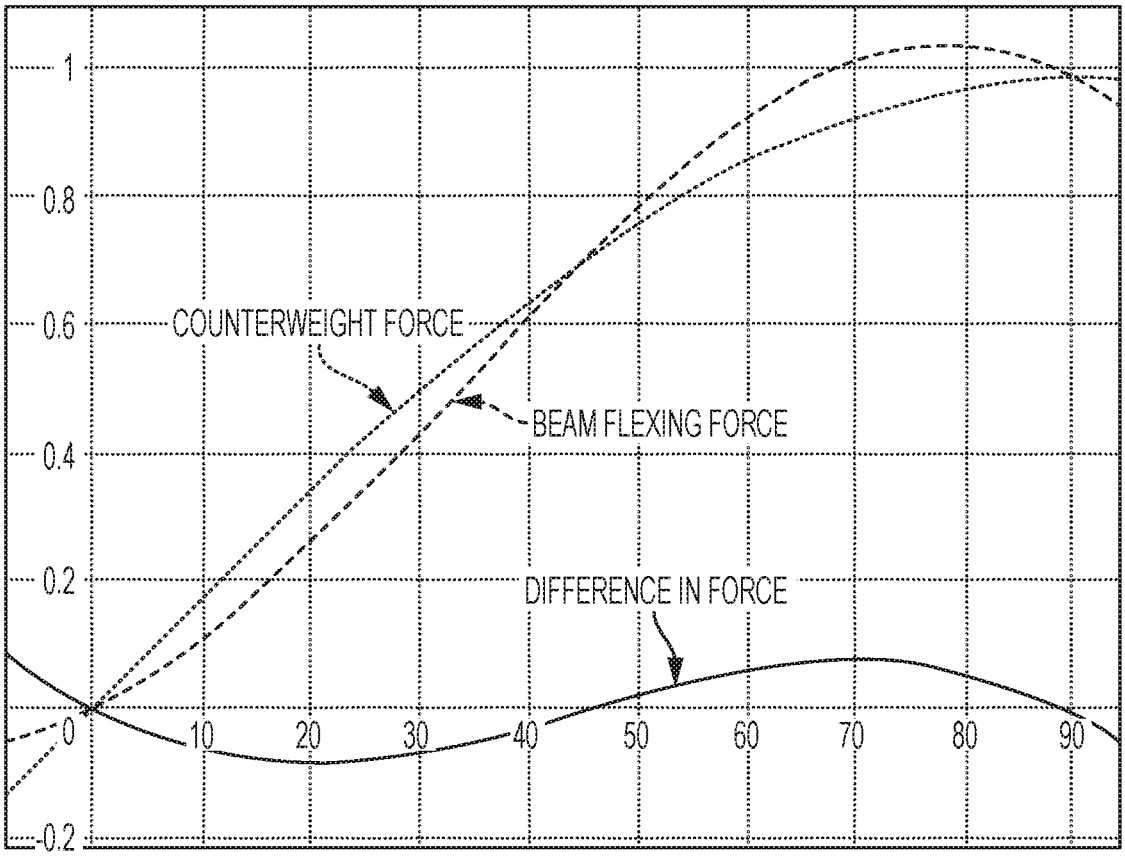
FIG. 7 is a graph of counterweight and beam flexing forces as a function of the position of a counterweight used in the actuating mechanism of FIG. 1.
Figure 8:
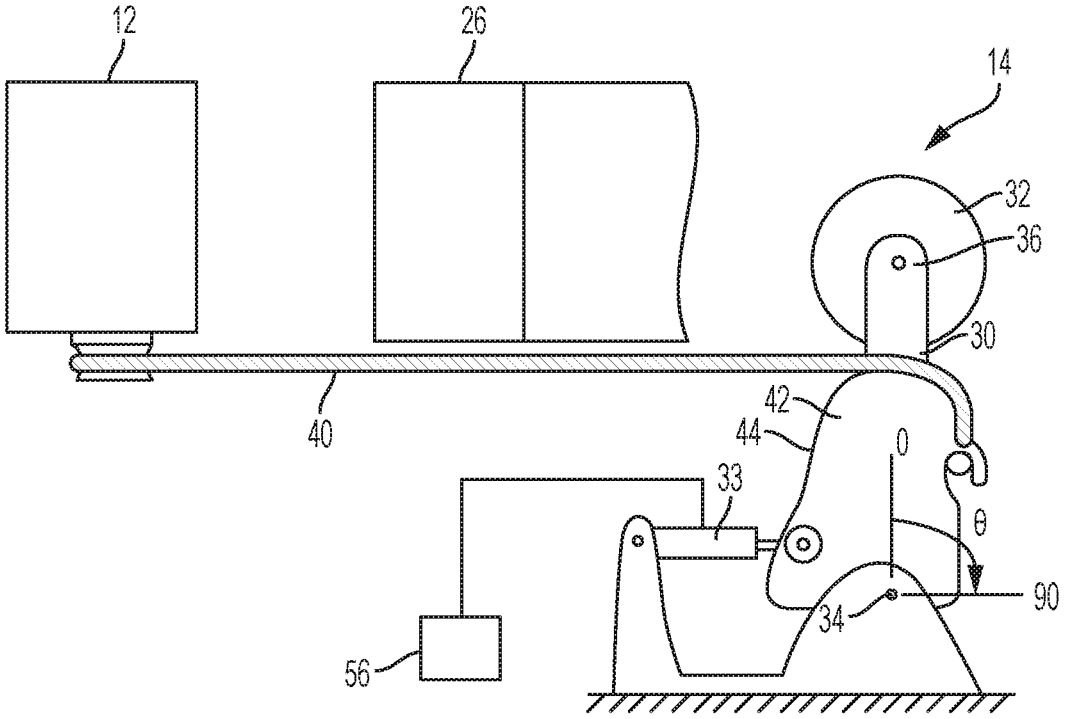
FIG. 8 is a front view of a monorail switch shown in tangent position in accordance with another embodiment of the present invention.

FIG. 7 depicts a graph of the reaction beam flexing force F and of the weight W as a function of the angular position of the lever 30 (or of the angular position of the counterweight 32 with respect to the fulcrum 34). Note that the reaction beam flexing force F, or the force required to laterally bend the moveable guide beam 12, results mostly from the effort required to laterally bend lateral running surfaces 48, the rest being some friction between components of the moveable guide beam 12. Knowing that for the system to be in equilibrium, and therefore stationary, the torque at the fulcrum must be equal to zero, we obtain:

$$T=M\cdot g\cdot r_c\cdot\sin\theta-F\cdot r_b\cos(45-\theta)=0$$

Where:

T is the resulting torque

M is the mass of the counterweight g is the gravitational constant $r_c$ is the lever arm of the linkage $r_b$ is the lever arm of the counterweight F is the beam flexing force induced in the linkage from bending the lateral running surfaces θ is the rotation angle of the counterweight The graph of FIG. 7 shows that the reaction beam flexing force F and the weight W are equal when 6 equals 0, 45 and 90 degrees. In between these angular positions, these forces are slightly different, by a factor of approximately 0.08, or 8%. Hence, the counterweight 32 compensates for at least 92% of the beam flexing force required to move the moveable guide beam 12 from its tangent position to its turnout position. In other words, shall the counterweight 32 be absent, the force required to be developed by the actuator 33 would be much larger.

In operation, a controller 56 receives a command to operate the monorail switch 10 so as to move the moveable guide beam 12 from its tangent position to its turnout position. The controller then sends a signal to the actuator 33 to displace the lever 30 and the counterweight 32 from an initial position where the counterweight 32 is located above the fulcrum 34, as depicted in FIG. 3, to a final position where the counterweight 32 is located beside the fulcrum 34, and approximately horizontally aligned with the fulcrum 34, as depicted in FIG. 4. As the counterweight 32 moves along an arc created by the lever 30 pivoting on its fulcrum 34, the torque resulting from the product of the weight W and the horizontal distance between the fulcrum 34 and the point of application of the force W (which is applied at the center of mass of the counterweight 32, assuming that the lever 30 and other moveable mass attached to it are relatively negligible with respect to the counterweight 32) gradually increases, at least partially compensating the torque generated by the product of the reaction beam flexing force F with the perpendicular distance between F and the fulcrum 34. When the moveable guide beam 12 has reached its turnout position and the operation is complete, the controller 56 sends a signal to the actuator 33 to stop. The displacement of the moveable guide beam 12 is then completed. At this stage, the controller 56 may send a signal to the actuator 33 to hold the position and/or a lock may be used to lock the moveable guide beam 12 in place until it has to be moved again. To revert back in the tangent position, the controller 56 sends signals to unlock the moveable guide beam 12 is necessary and to the actuator 33 to move the counterweight 32 back in its original position. As the torque created by the reaction beam flexing force F is always in opposite direction to the torque created by the weight W, only a small force is required from the actuator 33. When the moveable guide beam 12 reaches its tangent position, the controller 56 sends a signal to the actuator 33 to stop. The displacement of the moveable guide beam 12 is then completed. At this stage, the controller 56 may send a signal to the actuator 33 to hold the position and/or a lock may be used to lock the moveable guide beam 12 in place until it has to be moved again.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein. The invention is defined by the claims that follow.

What is claimed is:

1. A monorail switch for a monorail guideway, the monorail switch comprising:

a moveable guide beam, said moveable guide beam having a first end and a second end, said second end being adapted to be connected to the guideway, said moveable guide beam having lateral running surfaces on its left and right sides; and an actuating mechanism, said actuating mechanism having a body and a counterweight, said actuating mechanism body operatively connecting said moveable guide beam to said counterweight so as to move said moveable guide beam from a tangent position to a turnout position, wherein potential energy stored in said counterweight is released and at least partially stored in the form of elastic potential energy in said lateral running surfaces when said moveable guide beam is moved from said tangent position to said turnout position; and wherein said elastic potential energy stored in said lateral running surfaces is released and at least partially stored in the form of potential energy by said counterweight when said moveable guide beam is moved from said turnout position to said tangent position.

2. The monorail switch of claim 1 wherein said counterweight is in a high potential energy position when said moveable guide beam is in said tangent position and wherein said counterweight is in a low potential energy position when said moveable guide beam is in said turnout position.

3. The monorail switch of claim 2 wherein said actuating mechanism further comprises a lever, said lever having a fulcrum and a swinging extremity, said counterweight being connected to said swinging extremity.

4. The monorail switch of claim 3 wherein said counterweight is substantially vertically aligned above said fulcrum when said moveable guide beam is in said tangent position and wherein said counterweight is vertically offset from said fulcrum when said moveable guide beam is in said turnout position.

5. The monorail switch of claim 4 wherein said counterweight is horizontally aligned with said fulcrum when said moveable guide beam is in said turnout position.

6. The monorail switch of claim 3 wherein said counterweight has a mass M and wherein said lever has a length L, said mass M and said length L being selected so that a sum of torque at said fulcrum is null when said moveable guide beam is proximate said turnout position.

7. The monorail switch of claim 6 wherein said mass M and said length L are selected so that the sum of torque at said fulcrum is null when said moveable guide beam is proximate said tangent position.

8. The monorail switch of claim 1 wherein said actuating mechanism is connected to said moveable guide beam proximate said first end.

9. The monorail switch of claim 1 wherein said lateral running surfaces extend from a position proximate said first end to a position proximate said second end.

10. The monorail switch of claim 1 wherein said lateral running surfaces comprise an upper set and a lower set of running surfaces, said running surfaces of said upper set being connected together and said running surfaces of said lower set being connected together.

11. The monorail switch of claim 1 wherein said moveable guide beam comprises an alignment of segments pivotally connected end-to-end to each other by pivots, said lateral running surfaces extending on each sides of said segments.

12. The monorail switch of claim 11 wherein said moveable guide beam further comprises rotation stops between each one of said segments, said rotation stops preventing two adjacent segments from pivoting beyond a predetermined angle with respect to each other.

13. The monorail switch of claim 12 further comprising another rotation stop proximate said second end so as to prevent said segment at said second end from pivoting beyond a predetermined angle with respect to said guideway.

14. The monorail switch of claim 11 comprising at most one of said actuating mechanism, said actuating mechanism being connected to a single one of said segments having said first end of said moveable guide beam.

15. The monorail switch of claim 1 wherein said actuating mechanism is connected to said moveable guide beam through a linkage.

16. The monorail switch of claim 1 wherein said actuating mechanism further comprises a cam and a cable, said cable interconnecting said cam to said moveable guide beam, said cable being operative to conform at least partially to a profile of said cam as said moveable guide beam moves from said tangent position to said turnout position.

* * * * *